US011077490B2

(12) United States Patent
Hugenschütt et al.

(10) Patent No.: US 11,077,490 B2
(45) Date of Patent: Aug. 3, 2021

(54) PERMANENT MOLD PLATE AND PERMANENT MOLD

(71) Applicant: KME Germany GmbH & Co. KG, Osnabrück (DE)

(72) Inventors: Gerhard Hugenschütt, Belm (DE); Thomas Rolf, Osnabrück (DE)

(73) Assignee: KME GERMANY GMBH & CO. KG, Osnabrück (DE)

( * ) Notice: Subject to any disclaimer, the term of this patent is extended or adjusted under 35 U.S.C. 154(b) by 41 days.

(21) Appl. No.: 16/322,058

(22) PCT Filed: Dec. 15, 2017

(86) PCT No.: PCT/DE2017/101079
§ 371 (c)(1),
(2) Date: Jan. 30, 2019

(87) PCT Pub. No.: WO2018/113843
PCT Pub. Date: Jun. 28, 2018

(65) Prior Publication Data

US 2019/0184454 A1 Jun. 20, 2019

(30) Foreign Application Priority Data

Dec. 19, 2016 (DE) ..... 10 2016 124 801.0

(51) Int. Cl.
*B22D 11/055* (2006.01)
*B22D 11/057* (2006.01)

(52) U.S. Cl.
CPC ..... *B22D 11/055* (2013.01); *B22D 11/057* (2013.01)

(58) Field of Classification Search
CPC ..... B22D 11/055; B22D 11/057
USPC ..... 164/418, 459, 443, 485
See application file for complete search history.

(56) References Cited

U.S. PATENT DOCUMENTS

| | | | |
|---|---|---|---|
| 7,467,656 B2 | 12/2008 | Wobker et al. | |
| 2004/0069439 A1* | 4/2004 | Hugenschutt et al. | B22D 11/055 164/418 |
| 2010/0155570 A1 | 6/2010 | Kawa et al. | |

FOREIGN PATENT DOCUMENTS

| | | |
|---|---|---|
| CN | 1481952 A | 3/2004 |
| CN | 1170645 C | 10/2004 |
| CN | 1876275 A | 12/2006 |
| CN | 101772387 A | 7/2010 |
| DE | 102005026329 | 12/2006 |
| EP | 1900453 A2 | 3/2008 |

(Continued)

OTHER PUBLICATIONS

International Search Report dated Mar. 22, 2018 by the European Patent Office in International Application PCT/DE2017/101079.

(Continued)

*Primary Examiner* — Kevin P Kerns
(74) *Attorney, Agent, or Firm* — Henry M. Feiereisen LLC

(57) ABSTRACT

The invention relates to a permanent mold plate having a plurality of fastening points (3) on the rear side (2) thereof for fastening purposes, and cooling ducts (5) which are adjacent to the fastening points (3) and are in the form of depressions that are located within the rear side (2) and are open towards the rear side (2). From the perspective of a fastening point (3) towards the casting side (4) of the mold plate (1) opposite the rear side (2), at least one cooling duct (5) extends all the way to a point located below the fastening point (3).

16 Claims, 2 Drawing Sheets

(56) References Cited

FOREIGN PATENT DOCUMENTS

| | | | |
|---|---|---|---|
| JP | S 58-61951 | | 4/1983 |
| JP | S 6033854 | A | 2/1985 |
| JP | H 0335850 | A | 2/1991 |
| JP | H08-52537 | | 2/1996 |
| JP | 2006-320925 | | 11/2006 |
| JP | 2009006348 | | 1/2009 |
| JP | 2009-56490 | | 3/2009 |
| RU | 2106928 | C1 | 3/1998 |
| WO | WO2014076554 | A2 | 5/2014 |
| WO | WO2015059652 | A1 | 4/2015 |

OTHER PUBLICATIONS

Chinese Search Report dated Jul. 10, 2020 with respect to counterpart Chinese patent application 2017800596859.
Translation of Chinese Search Report dated Jul. 10, 2020 with respect to counterpart Chinese patent application 2017800596859.
Chinese Search Report dated Mar. 9, 2021 with respect to counterpart Chinese patent application No. 201780059685.9.
English translation of Chinese Search Report dated Mar. 9, 2021 with respect to counterpart Chinese patent apptication No. 201780059685.9.

* cited by examiner

PERMANENT MOLD PLATE AND PERMANENT MOLD

CROSS-REFERENCES TO RELATED APPLICATIONS

This application is the U.S. National Stage of International Application No. PCT/EP2017/101079, filed Dec. 15, 2017, which designated the United States and has been published as International Publication No. WO 2018/113843 and which claims the priority of German Patent Application, Serial No. 10 2016 124 801.0, filed Dec. 19, 2016, pursuant to 35 U.S.C. 119(a)-(d).

BACKGROUND OF THE INVENTION

A permanent mold plate as well as to a permanent mold having such a permanent mold plate.

Permanent mold plates of copper are used in continuous casting, in particular in thin-strip continuous casting plants. The copper permanent molds which are composed of a plurality of permanent mold plates are usually fastened by way of various fastening elements, in most instances screws, to a water box required for cooling, or to a support plate. The fastening elements are fastened to fastening points on the rear side of the permanent mold plate, as is shown in US 2010/0 155 570 A1, for example.

Streamlined plateau pedestals at the fastening points which are to preclude thermal overstresses are proposed in DE 10 2005 026 329 A1. JP 2006-320 925 A1 proposes cooling ducts at the base of the fastening bolts. So-called spacers between the permanent mold plate and the piece plate are also used so as to direct the cooling water to specific paths (JP 2009-56 490 A). The prior art also includes that webs between two fastening points are designed so as to be narrower than the region of the fastening points, and moreover that the cross section of the cooling ducts is varied so as to optimize cooling. Said regions are difficult to cool. Comparatively high temperatures arise here, the latter being referred to as hot spots. Said points of elevated temperature lead to inhomogeneous cooling on the casting side. Material stresses are created within the permanent mold plate. Unfavorable cooling conditions can lead to the quality being compromised in the casting strand which is to be cooled by way of the permanent mold.

Comparatively high temperatures that arise locally in the casting surface of the permanent mold plate in the region of the fastening points, by virtue of the higher stresses in said region, can lead to cracks and to softening of the copper alloy, and consequently to plastic deformations in said regions. The literature refers to this effect as bulging. Bulging has the effect that a gap is formed between the narrow sides and the wide sides of the permanent mold. Liquid steel can enter said gap and solidify therein. On account thereof, the strand shell of the casting strand can rupture in the further course of the permanent mold, this in turn potentially leading to a breakthrough in the corner region of the strand shell below the permanent mold. This is associated with very high consequential costs for the operator of the plant. A timely reworking of the casting surfaces of the wide sides is required in order for the risk of a strand breakthrough to be minimized. The number of possible rework jobs is however limited.

In order for hot spots to be avoided on the casting areas, a reduction in the number of fastening elements and/or in the size of the latter is pursued. Cooling water is simultaneously guided close to the fastening points, that is to say typically to threaded inserts for receiving expansion screws. As a further measure, additional cooling ducts can be incorporated between the fastening points, so as to achieve a uniform cooling efficiency across the entire permanent mold surface. The cooling ducts can be guided around the fastening points in a serpentine manner. It is also known for comparatively complex deep bores to be provided in the case of funnel permanent mold plates, said deep bores guiding the cooling water close to the casting side below the fastening points.

The minimizing of the size of the fastening points is limited by the strength of the copper material and the fastening material. The cooling ducts guiding around the fastening points cause a more homogeneous distribution of heat between the fastening points but cannot per se prevent the hot spots in the region of the fastening points.

Cooling bores which run between the fastening points and the casting side are associated with high production costs. Each deep-hole bore has to be separately closed by means of a stopper, this bearing the risk of a leakage. Said deep bores additionally require supply bores which guide the cooling water. Significant pressure losses are typically created on account of the various bores. Moreover, the cleaning complexity by virtue of the difficult accessibility cannot be underestimated.

Proceeding therefrom, the invention is based on the object of specifying a permanent mold plate which, without any structural weakening, enables the reduction of hot spots without the production complexity being increased on account of complex deep bores. A corresponding permanent mold having improved properties is to be specified.

SUMMARY OF THE INVENTION

According to one aspect of the present invention, the object is achieved by a permanent mold plate which for fastening on the rear side thereof has a plurality of fastening points, wherein cooling ducts in the form of depressions which are open toward the rear side and are disposed in the rear side run so as to neighbor the fastening points, wherein at least one cooling duct, when viewed from a fastening point to the casting side thereof of the permanent mold plate that is opposite the rear side, extends up to below the fastening point.

According to another aspect of the present invention, the object is achieved by a permanent mold having permanent mold plates as set forth above, for delimiting a format cross section of a casting strand.

The dependent claims relate to advantages refinements of the invention.

The permanent mold plate according to the invention, on the rear side thereof, has a plurality of fastening points. Fastening points in the context of the invention are primarily fastening points which can absorb a force perpendicular to the permanent mold plate. Said fastening points are in particular screw connections. By virtue of the relatively low strength of copper, threaded inserts are preferably incorporated at the fastening points. The threaded inserts are in turn surrounded by the material of the permanent mold plate. A fastening point in the context of the invention is also a receptacle into which a feather key or a dowel pin can be inserted so as to establish the position of the permanent mold plate. Fastening points serve for coupling the permanent mold plate either to a water box or to a rearward support plate.

Cooling ducts in the form of depressions which are open toward the rear side are disposed in the rear side of the fastening plate. The cooling ducts preferably run in the casting direction of the metal strand to be cooled, that is to say from top to bottom. It is provided according to the invention that at least one cooling duct, when viewed from a fastening point to the casting side thereof of the permanent mold plate that is opposite the rear side, extends up to below the fastening points. When viewed from the fastening point, this means that the fastening point including the wall thereof is projected from the material of the permanent mold plate perpendicularly onto the plane of the casting side. There usually are no cross-sectional reductions below said projected face, or below the fastening point, respectively, so that the force that is exerted on the fastening point can be transmitted without any stress peaks to the casting side of the permanent mold plate. However, it has been established in the context of the invention that the temperature increase in the region of the fastening points can be significantly reduced on account of widened cooling ducts, in particular in the transition region to the casting plate, without the stress on the material increasing in the region of the fastening points. A further advantage is that the region of the hot spots can be positively cooled so that cost-intensive deep bores for cooling bores below the fastening points can be dispensed with. The cooling ducts according to the invention, which extend up to below the fastening points, of course do not reach that far below the fastening point such that the latter no longer has any direct contact with the actual casting side. The cross section only in the transition region to the casting side is reduced to the extent that the permanent mold plate is securely held but the temperature increase in the region of the hot spots is reduced at the same time.

The heat discharge can already be improved in that a cooling duct extends up to below a fastening point on one side of the fastening point. The permanent mold plate according to the invention can however also be designed such that cooling ducts extend up to below a fastening point on both sides of the fastening point. A constriction below the fastening point is achieved, so to speak, said constriction being in particular configured so as to be symmetrical. In geometrical terms, and when viewed from the rear side, this is an undercut. In functional terms, this is a widening of the base of the cooling duct.

In an advantageous refinement of the invention, cooling slots that run in the longitudinal direction of the cooling ducts are configured in the cooling ducts. The cooling slots expand the cooling duct and are part of the cooling duct. At least one cooling slot is configured in a side wall of the cooling duct and extends to below at least one fastening point.

A cooling duct in the context of the invention possesses two opposite side walls which are connected by way of a base. The base is the rear side of the casting side and runs so as to be spaced apart from the rear side of the permanent mold plate. The side walls are in part formed by the fastening points. The cooling slots in regions once again reduce the thickness of the permanent mold plate, or the spacing of the cooling water from the casting side, respectively, without weakening the permanent mold plate including the structure of the latter. The cooling slots consequently are comparatively small regions of the cooling duct. Said cooling slots are produced using comparatively small machining tools, in particular using side milling cutters or end mills. On account thereof, it is possible for cooling slots to be configured in particular in the corner region between the side wall of the cooling duct and a base of the cooling duct that faces the casting side of the permanent mold plate. This region is relatively difficult to access, depending on the width of the cooling duct. However, cooling slots enable even these thermally highly stressed regions of the permanent mold plate to be better cooled in that the cooling water is guided closer to the individual hot spots, without the structure of the permanent mold plate being weakened.

The cooling slots possess in particular a consistent cross section, and between a flow entry of the cooling slot and a flow exit of the cooling slot are free of any current-free regions. A cooling slot which extends up to below a fastening point can in particular be produced by a side milling cutter such that the cross section of the cooling slot across the entire length thereof remains identical for production-related reasons. The consistent cross section has to be emphasized in particular because the cross section in the remaining regions of the larger cooling duct from which the cooling slot branches off does not have to be constant. The fastening points are specifically preferably disposed in webs which are likewise component parts of the side walls of cooling ducts. The fastening points are indeed slightly weakened on account of the constriction in the bottom region of said fastening points, but the fastening points are held by webs. The webs have the effect of supporting the fastening points that project in a pillar-like manner. The webs and the cooling ducts run so as to be mutually parallel, wherein the webs between the fastening points are substantially narrower in the cross section than the fastening points. Therefore, the cross section of the cooling ducts in the flow direction is not constant on account of the shape of the mutually alternating webs and fastening points, while the cross section of the cooling slots remains constant. This enables continuous and homogeneous cooling in the pedestal region of the fastening points.

Once the cooling slots have been produced by an end mill, a side milling cutter, or another suitable milling tool, inserts can be inserted into the cooling duct that is open toward the rear side of the permanent mold plate. These inserts can cover the cooling slots and, on account thereof, increase the flow rate in the region of the cooling slots. This measure can contribute toward homogeneous, uniform and efficient cooling across the entire casting face. Dead zones caused by current-free regions in the cooling duct are entirely avoided in particular on account of the inserts.

The advantages of the invention come to bear in particular when all of the fastening points are at least in regions engaged from below by the lateral widenings of the cooling duct. However, it is also possible for only those fastening points which are exposed to particularly high thermal stresses to be cooled more intensely. Fastening points in the mold level region of the permanent mold benefit to the maximum extent from the additional cooling of the hot spots.

The invention has the advantage that the permanent mold plate that expands under casting conditions, by virtue of the special cooling duct geometry, enables the fastening points to be linked by way of a very thin wall. This in turn has the consequence of lower material stresses in the permanent mold plate such that threaded inserts of accordingly smaller dimensions can be used in the fastening points. It has been demonstrated that a mechanical reduction in the constructive strength does indeed arise by virtue of the thin-walled link, this however being able to be compensated for as a consequence of improved, that is to say more uniform, cooling, because greater high-temperature strengths can be achieved in a localized manner at lower temperatures. Heat-related flexural moments are lower than those to be expected, since the temperature differentials can be significantly reduced on account of the optimized cooling.

The invention relates not only to a single permanent mold plate, but also to a complete permanent mold comprising permanent mold plates as have been described above. Such a permanent mold serves for the continuous casting of thin strips. Additionally to the above-described permanent mold plates, narrower permanent mold plates by way of which the above-described permanent mold plates are spaced apart are provided on the narrow sides of the format cross section of the permanent mold to be delimited. These narrower permanent mold plates on the rear side thereof can also be equipped with corresponding cooling ducts, wherein at least one cooling duct, when viewed from a rearward fastening point of the narrow-side permanent mold plate to the casting side thereof of the permanent mold plate that is opposite the rear side, extends up to below the fastening point. The disposal and the design of the cooling ducts can be performed in a manner analogous to the design of the rear sides of the larger permanent mold longitudinal plates. The interior space between the permanent mold plates in a known manner tapers in a funnel-shaped manner in the casting direction. While the casting side of the permanent mold plate consequently possesses a rounded contour, the rear side of the permanent mold plate has a multiplicity of cooling ducts that run in the longitudinal direction, so as to effectively cool the permanent mold plates and so as to avoid said hot spots in the region of the fastening points to a water box or a rearward support plate.

BRIEF DESCRIPTION OF THE DRAWING

The invention will be explained in more detail hereunder by means of an exemplary embodiment illustrated in the schematic drawings in which.

DETAILED DESCRIPTION OF PREFERRED EMBODIMENTS

Figure 1:
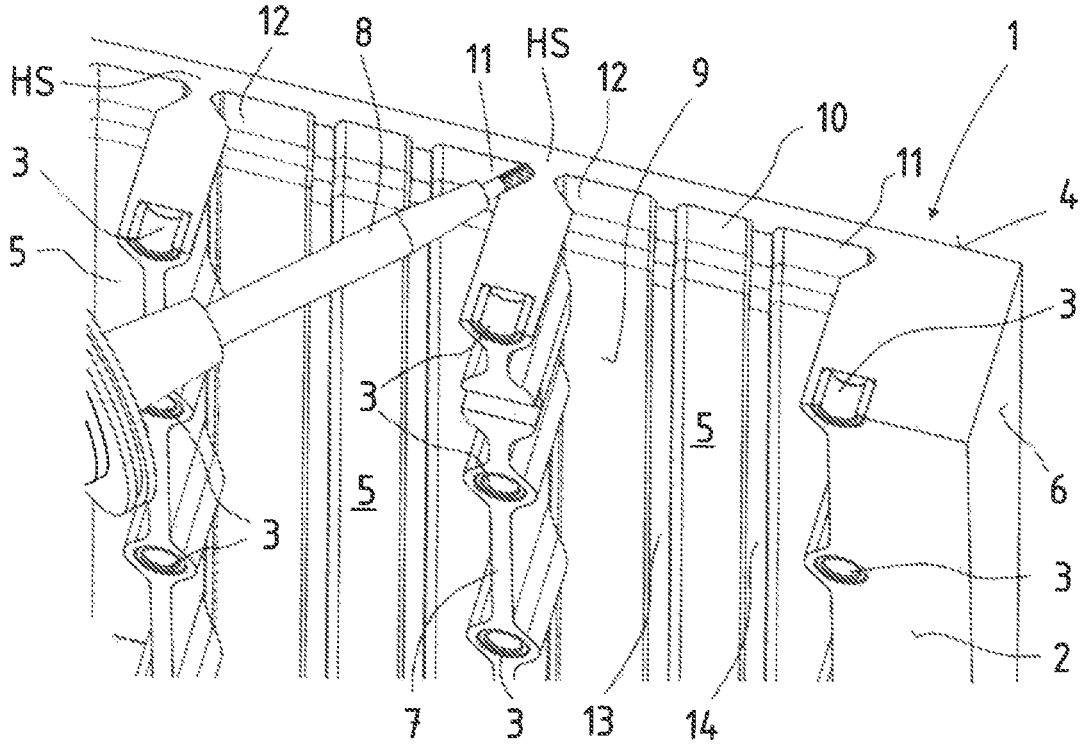
FIG. 1 shows a horizontal sectional illustration of a rear side of a permanent mold plate.

FIG. 1 shows a sectional illustration through a permanent mold plate 1. The section plane runs in the horizontal direction. The permanent mold plate 1 is shown in a perspective illustration from the rear side, wherein only a part-region of a longitudinal edge and of the rear side of the permanent mold plate are to be seen.

The rear side 2 of the permanent mold plate 1 is the rear-side plane in which a plurality of fastening points 3 are disposed. The fastening points 3 are provided for connecting the permanent mold plate 1 to a water box (not illustrated in more detail) or to a support plate. To this end, the fastening points 3 possess threaded inserts which are inserted in bores in the rear side 2 of the permanent mold plate 1.

That side of the permanent mold plate 1 that is opposite the rear side 2 is the casting side 4 by way of which a strand of metal to be cooled is cooled. A plurality of permanent mold plates 1 in a manner not illustrated in more detail delimit a format cross section of a typically rectangular casting strand. The permanent mold plate 1 is cooled by water which is directed through cooling ducts 5 which in the image plane of FIG. 1 extend from top to bottom, so as to be parallel to a longitudinal side 6 of the permanent mold plate 1. The cooling ducts 5 run so as to be mutually parallel and in the form of substantially rectangular depressions are open toward the rear side 2 of the permanent mold plate 1. The cooling ducts 5 are mutually separated by way of narrow webs 7. The webs 7 connect two neighboring or successive, respectively, fastening points 3 to one another. The wall thickness of the webs 7 between the fastening points 3 is substantially smaller than below a fastening point 3, as can be seen by means of the position of the section plane. The fastening point 3 that is central in the section plane of FIG. 1 is configured in a pillar-like manner, so to speak, and possesses a constant cross section across the predominant longitudinal region thereof. Said longitudinal region is wider than the web 7 adjacent thereto.

However, the width is reduced in the transition to the rearward side of the casting side 4. A milling tool 8 in the form of an end mill highlights that constrictions are produced in the pedestal region of the fastening points 3. The constrictions are configured so as to be symmetrical. Said constrictions lead to a widening of the cooling duct 5 in the region of the base 9 thereof.

It can furthermore be seen that the base 9 of the cooling ducts 5 overall is not planar but possesses a plurality of cooling slots 10, 11, 12 which are in each case mutually separated by webs 13, 14 that run so as to be mutually parallel. The three cooling slots 10, 11, 12 possess a constant cross section. The cooling slots 11, 12 that are disposed on the periphery of the base 9, when viewed from the fastening points 3, configure undercuts, and, when viewed from the fastening points 3 in the direction toward the casting side 4, engage below the fastening points 3.

A region of the casting side 4, identified by the reference sign HS, is identified as a so-called hot spot in FIG. 1. Hot spots HS of this type are located below each fastening point 3 on the casting side 4, because the heat from the casting side 4 in this region to date has been able to be only insufficiently discharged by the coolant. However, it can be seen that the region of the hot spot HS on account of the cooling ducts 5 widened in the base region, or the cooling slots 11, 12 disposed therein, respectively, in the case of the invention is reduced in size geometrically and also on account of improved cooling. The cross section in the region below the fastening points 3 is reduced by approx. 50%. At the same time, the cooling slots 12 possess a constant cross section such that cooling water can be guided past the hot spots HS at a high flow rate and can very effectively discharge the thermal energy from said regions. The hot spots HS in thermal terms become significantly smaller on account thereof. The temperature variations on the casting side 4 are significantly lower.

Figure 2:
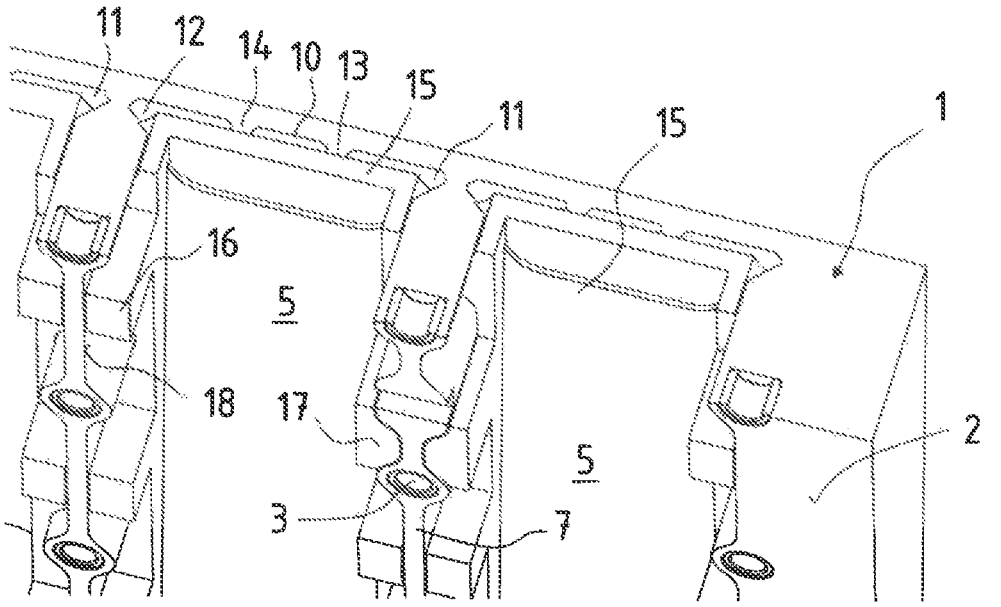
FIG. 2 shows the permanent mold plate of FIG. 1 having assembled inserts.

FIG. 2 shows the same permanent mold plate 1 as in FIG. 1. Additionally, inserts 15 are inserted from the rear side 2 into the cooling ducts 5. It can be seen that the inserts 15 are supported on the webs 13, 14 and in terms of height extend up to the rear side 2. To this end, lateral parts 16, 17 which are adapted to the contour of the webs 7, or to the sidewalls 18 of the cooling ducts 5, respectively, are located in the region of the webs 7 between the fastening points 3. On account of the inserts 15, the flow rate within the cooling slots 10, 11, 12 is significantly increased. The lateral parts 16, 17 extend up to the rear side 2 of the permanent mold plate 1, such that said lateral parts 16, 17 even under the pressure of the coolant securely bear on the webs 13, 14 on the base 9 of the cooling ducts 5, and reliably guarantee the guiding of the flow. The pedestal regions of the fastening points 3 are particularly effectively cooled.

Figure 3:
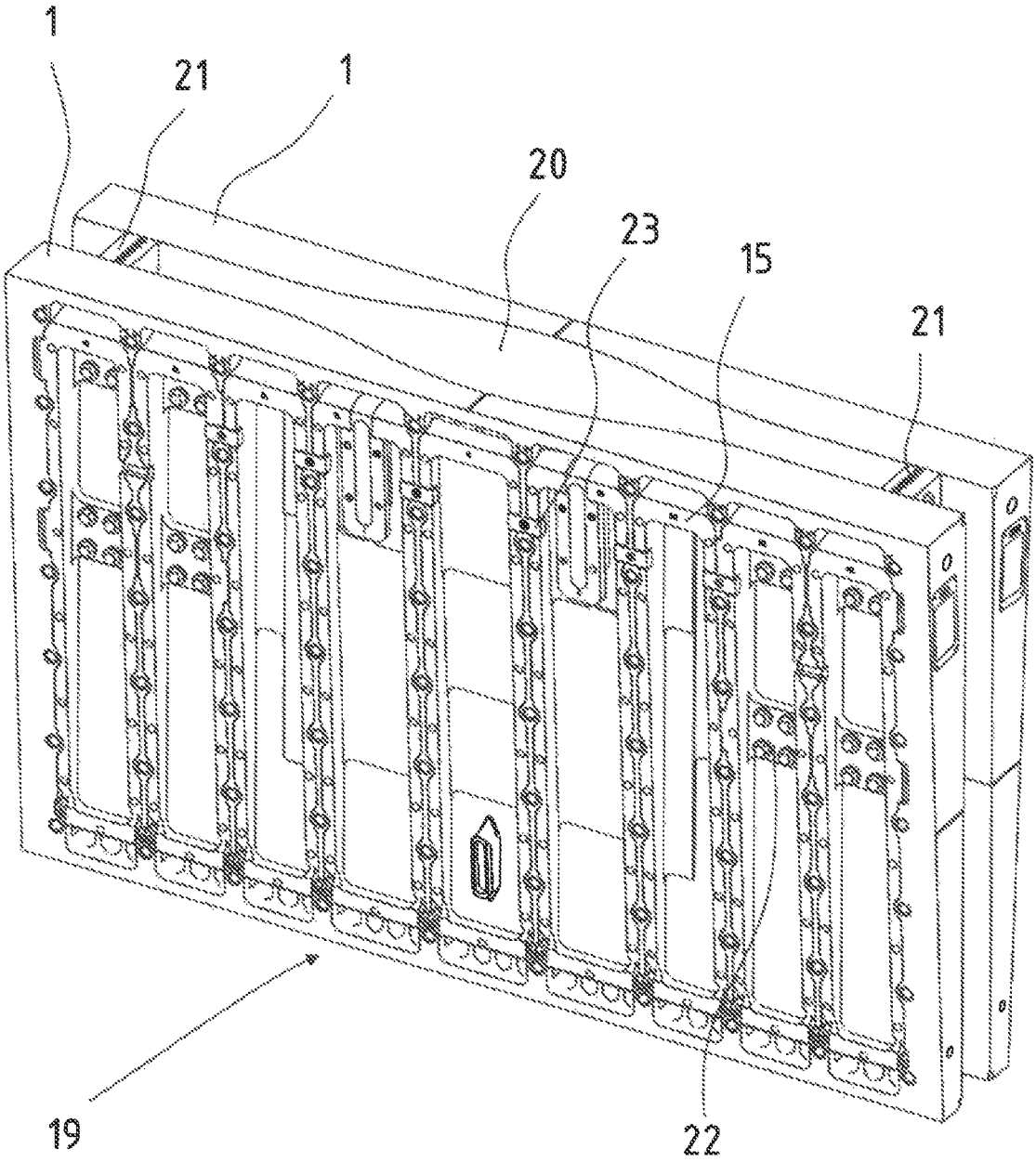
FIG. 3 shows a permanent mold from a plurality of permanent mold plates.

FIG. 3 in a perspective illustration shows a permanent mold 19. The permanent mold 19 possesses two mutually opposite permanent mold plates 1 according to the preceding exemplary embodiment. The two permanent wall plates 1 are spaced apart and in the center configure a molding cavity 20 that tapers in a funnel-shaped manner in the casting direction. The narrow sides of the molding cavity 20 are delimited by way of narrow-side plates 21. Consequently, the permanent mold plates 1 in combination with the narrow-side plates 21 delimit the format cross section of a casting strand that is rectangular at the exit end of the permanent mold 19.

The two permanent mold plates 1 are of identical configuration. A complete rear side 2 of the permanent mold plate 1, in which the inserts 15 can also be seen, can be seen in the illustration of FIG. 3. The inserts 15 are held on the rear side 2 in part by way of screw connections 22 and in part by way of clamps 23. The permanent mold plates 1 in the installed position are screw-fitted to a water box (not illustrated in more detail) or to a support plate. The inserts 15 in this instance are also supported on the water box, or on the support plate, respectively.

What is claimed is:

1. A permanent mold plate, comprising:

a casting side;

a rear side opposite to the casting side and including a plurality of fastening points; and cooling ducts disposed in the rear side in neighboring relation to the fastening points and configured in the form of depressions which are open and uncovered toward the rear side, at least one of the cooling ducts, when viewed linearly from a one of the fastening points on the rear side to the casting side opposite the rear side, extending in line with the one of the fastening points, said at least one of the cooling ducts having a base that faces the casting side and being widened in a region of the base so as to form at least one constriction in linear relationship to the one of the fastening points, wherein the cooling ducts have formed therein cooling slots which run in a longitudinal direction of the cooling ducts, at least one of the cooling slots being configured in a side wall of the cooling duct and extending up to below at least one of the fastening points, wherein the cooling slots are configured as undercuts and separated by webs.

2. The permanent mold plate of claim 1, wherein two of the cooling ducts are disposed on both sides of a one of the fastening points in the rear side, said two of the cooling ducts extending up to below the one of the fastening points.

3. The permanent mold plate of claim 1, wherein one of the cooling slots extends in a corner region between the side wall of the cooling duct and a base of the cooling duct in facing relation to the casting side.

4. The permanent mold plate of claim 1, wherein the at least one of the cooling slots which extends up to below the at least one of the fastening points possesses a consistent cross section and is free of any current-free region between a flow entry and a flow exit.

5. The permanent mold plate of claim 1, wherein the side walls of the cooling ducts have further webs which are disposed between the fastening points and shaped such that as a result of the shape of the webs and the fastening points, a cross section of the cooling ducts is not constant in the flow direction, while a cross section of the cooling slots is constant.

6. The permanent mold plate of claim 1, further comprising inserts configured to cover the cooling slots and disposed in the cooling ducts.

7. The permanent mold plate of claim 1, further comprising a mold level region, said cooling ducts extending up to below those fastening points that are disposed in the mold level region.

8. A permanent mold, comprising a plurality of permanent mold plates for delimiting a format cross section of a casting strand, each said permanent mold plate comprising a casting side, a rear side opposite to the casting side and including a plurality of fastening points, and cooling ducts disposed in the rear side in neighboring relation to the fastening points and configured in the form of depressions which are open and uncovered toward the rear side, at least one of the cooling ducts, when viewed from a one of the fastening points on the rear side to the casting side opposite the rear side, extending in line with the one of the fastening points, said at least one of the cooling ducts having a base that faces the casting side and being widened in a region of the base so as to form at least one constriction in linear relationship to the one of the fastening points, wherein the cooling ducts have formed therein cooling slots which run in a longitudinal direction of the cooling ducts, at least one of the cooling slots being configured in a side wall of the cooling duct and extending up to below at least one of the fastening points, wherein the cooling slots are configured as undercuts and separated by webs.

9. The permanent mold of claim 8, wherein two of the cooling ducts are disposed on both sides of a one of the fastening points in the rear side, said two of the cooling ducts extending up to below the one of the fastening points.

10. The permanent mold of claim 8, wherein one of the cooling slots extends in a corner region between the side wall of the cooling duct and a base of the cooling duct in facing relation to the casting side.

11. The permanent mold of claim 8, wherein the at least one of the cooling slots which extends up to below the at least one of the fastening points possesses a consistent cross section and is free of any current-free region between a flow entry and a flow exit.

12. The permanent mold of claim 8, wherein the side walls of the cooling ducts have further webs which are disposed between the fastening points and shaped such that as a result of the shape of the webs and the fastening points, a cross section of the cooling ducts is not constant in the flow direction, while a cross section of the cooling slots is constant.

13. The permanent mold of claim 8, wherein the permanent mold plate includes inserts configured to cover the cooling slots and disposed in the cooling ducts.

14. The permanent mold of claim 8, wherein the permanent mold plate includes a mold level region, said cooling ducts extending up to below those fastening points that are disposed in the mold level region.

15. A permanent mold plate, comprising:

a casting side;

a rear side opposite to the casting side and including a plurality of fastening points;

cooling ducts disposed in the rear side in neighboring relation to the fastening points and configured in the form of depressions which are open and uncovered toward the rear side, at least one of the cooling ducts, when viewed linearly from a one of the fastening points on the rear side to the casting side opposite the rear side, extending in line with the one of the fastening points, said at least one of the cooling ducts having a base that faces the casting side and being widened in a region of the base so as to form at least one constriction in linear relationship to the one of the fastening points, wherein the cooling ducts have formed therein cooling slots which run in a longitudinal direction of the cooling ducts, at least one of the cooling slots being configured in a side wall of the cooling duct and extending up to below at least one of the fastening points; and inserts configured to cover the cooling slots and disposed in the cooling ducts.

16. A permanent mold, comprising a plurality of permanent mold plates for delimiting a format cross section of a casting strand, each said permanent mold plate comprising a casting side, a rear side opposite to the casting side and including a plurality of fastening points, and cooling ducts disposed in the rear side in neighboring relation to the fastening points and configured in the form of depressions which are open and uncovered toward the rear side, at least one of the cooling ducts, when viewed from a one of the fastening points on the rear side to the casting side opposite the rear side, extending in line with the one of the fastening points, said at least one of the cooling ducts having a base that faces the casting side and being widened in a region of the base so as to form at least one constriction in linear relationship to the one of the fastening points, wherein the cooling ducts have formed therein cooling slots which run in a longitudinal direction of the cooling ducts, at least one of the cooling slots being configured in a side wall of the cooling duct and extending up to below at least one of the fastening points, wherein the permanent mold plate includes inserts configured to cover the cooling slots and disposed in the cooling ducts.

* * * * *